US011466676B2

(12) United States Patent
Elberson

(10) Patent No.: US 11,466,676 B2
(45) Date of Patent: Oct. 11, 2022

(54) CONTROL ARRANGEMENT AND METHOD FOR OPERATING DIAPHRAGM PUMP SYSTEMS

(71) Applicant: Autoquip, Inc., Menomonee Falls, WI (US)

(72) Inventor: Michael D. Elberson, Elm Grove, WI (US)

(73) Assignee: Autoquip, Inc., Menomonee Falls, WI (US)

( * ) Notice: Subject to any disclaimer, the term of this patent is extended or adjusted under 35 U.S.C. 154(b) by 248 days.

(21) Appl. No.: 16/433,103

(22) Filed: Jun. 6, 2019

(65) Prior Publication Data

US 2020/0025192 A1 Jan. 23, 2020

Related U.S. Application Data

(60) Provisional application No. 62/699,258, filed on Jul. 17, 2018.

(51) Int. Cl.

| | |
|---|---|
| ***F04B 49/06*** | (2006.01) |
| ***F04B 43/02*** | (2006.01) |
| ***F04B 43/073*** | (2006.01) |
| ***F04B 43/06*** | (2006.01) |
| ***F04B 11/00*** | (2006.01) |

(52) U.S. Cl.

CPC ..... *F04B 49/06* (2013.01); *F04B 43/02* (2013.01); *F04B 43/06* (2013.01); *F04B 43/0736* (2013.01); *F04B 11/005* (2013.01)

(58) Field of Classification Search

CPC ..... F04B 43/02; F04B 43/023; F04B 43/025; F04B 43/026; F04B 43/06; F04B 43/073; F04B 43/0736; F04B 43/14; F04B 49/06

See application file for complete search history.

(56) References Cited

U.S. PATENT DOCUMENTS

| | | | | |
|---|---|---|---|---|
| 1,835,919 A | | 12/1931 | Waseige | |
| 3,070,030 A | | 12/1962 | Mashinter | |
| 3,164,101 A | | 1/1965 | Van Nederynen | |
| 3,781,141 A | | 12/1973 | Schall | |
| 4,705,462 A | * | 11/1987 | Balembois | F04B 43/06 417/395 |

(Continued)

FOREIGN PATENT DOCUMENTS

FR 2177181 A5 * 11/1973 ..... F04B 43/073

OTHER PUBLICATIONS

English translation of FR2177181A5 (Year: 1973).*

*Primary Examiner* — Nathan C Zollinger

(74) *Attorney, Agent, or Firm* — Boyle Fredrickson S.C.

(57) ABSTRACT

A diaphragm pump system that includes a pair of working fluid diaphragm pump assemblies that are each fluidly connected to a working fluid flow. Each working fluid diaphragm pump assembly is operationally associated with a discrete drive arrangement that is fluidly isolated from the working fluid flow that is moved during operation of the pump system. A control arrangement is connected to the discrete drive arrangements and configured to control the cyclic operation of the pair of working fluid diaphragm pump assemblies to mitigate pulsatile effects in the combined working fluid flow when the discharges of the working fluid flows associated with operation of the pair of working fluid diaphragm pump assemblies is combined.

20 Claims, 9 Drawing Sheets

(56) References Cited

U.S. PATENT DOCUMENTS

| | | | | | |
|---|---|---|---|---|---|
| 4,781,213 | A | * | 11/1988 | Kilayko | F16K 1/465 137/516.27 |
| 4,844,706 | A | * | 7/1989 | Katsuyama | B05B 7/24 417/339 |
| 5,219,274 | A | | 6/1993 | Pawlowski et al. | |
| 5,252,041 | A | * | 10/1993 | Schumack | F04B 43/073 417/395 |
| 5,279,504 | A | * | 1/1994 | Williams | F04B 13/00 417/393 |
| 5,332,372 | A | * | 7/1994 | Reynolds | F04B 43/009 417/393 |
| 5,772,899 | A | | 6/1998 | Snodgrass et al. | |
| 6,299,415 | B1 | | 10/2001 | Bahrton | |
| 6,923,255 | B2 | * | 8/2005 | Lee | E21B 21/103 166/154 |
| 8,932,031 | B2 | | 1/2015 | Maguire et al. | |
| 9,004,877 | B2 | | 4/2015 | Becker et al. | |
| 2007/0177998 | A1 | * | 8/2007 | Kato | F04B 43/0081 417/540 |
| 2015/0226192 | A1 | | 8/2015 | Hines et al. | |
| 2017/0009760 | A1 | * | 1/2017 | Lutz | F04B 43/0736 |
| 2017/0218943 | A1 | * | 8/2017 | Ellis | F04B 51/00 |

* cited by examiner

CONTROL ARRANGEMENT AND METHOD FOR OPERATING DIAPHRAGM PUMP SYSTEMS

CROSS-REFERENCE TO RELATED APPLICATIONS

This application claims priority to U.S. Provisional Patent Application Ser. No. 62/699,258 filed on Jul. 17, 2018, the disclosure of which is incorporated herein by reference.

FIELD OF THE INVENTION

The present invention relates to construction and operation of diaphragm pumps, and in particular, to an assembly and method of mitigating respective side specific pressure deviations experienced during the cyclic operation of diaphragm pump systems that include independently operable diaphragms.

BACKGROUND OF THE INVENTION

Diaphragm pumps are commonly understood as positive displacement pumps that offer smooth flow, reliable operation, and the ability to pump a wide variety of viscous, chemically aggressive, abrasive and impure liquids. Some such pumps commonly include a pair of pumping diaphragms that are each associated with a respective pump or pumping diaphragm chamber. Each of the respective pumping diaphragms are commonly operatively associated with a shaft which oscillates in opposite axial directions during the intake and exhaust strokes associated with movement of the discrete diaphragms. Such pumps are used in many industries such as mining, chemical, petro-chemical, pulp, paper, and other industries. Such paired pumping diaphragm pump assemblies are susceptible to some shortcomings.

During operation of such pumps, an air valve directs pressurized gas, such as air, in a generally alternating sequential manner to each of the respective diaphragm chambers of a pair of diaphragm chambers. The gas flow pushes a respective diaphragm across a respective chamber and a fluid on an opposite side of the diaphragm is forced out of the fluid side of the discrete diaphragm chamber. During the discharge stroke associated with one diaphragm chamber, the diaphragm associated with the opposite chamber is pulled towards the center of the pump assembly or in a common direction relative to translation of the first diaphragm, by the shaft or connecting rod, thereby effectuating an intake stroke associated with one diaphragm chamber during the discharge stroke associated with the opposing discharge chamber. That is, the cyclic operation of the shaft, and the diaphragms associated therewith, creates a liquid suction pressure in one diaphragm chamber during the pressure or discharge stroke associated with operation of the opposite diaphragm.

When provided in a dual diaphragm pump assembly, when a retracting diaphragm or respective diaphragm plate associated with one diaphragm approaches a center portion of the pump assembly, it interacts with a pilot valve rod which diverts a pulse of air that is directed to the air valve thereby diverting the working gas flow toward an alternate passage associated with the valve assembly so as to direct the connecting rod, and the respective diaphragm associated therewith, in a respective opposite axial direction. Movement of the pilot valve rod also commonly effectuates fluid connectivity associated with the gas side of the pumping diaphragm associated with the recently discharged pump chamber to allow the gas charge associated with each fluid discharge stroke to be directed toward an outlet or an exhaust.

The pneumatic operation of such pumps allows utilization of the same in instances where electrically driven pumps are not preferred. Such pumps are commonly self-priming, can withstand periods of being operated with a fluid flow, and can be constructed of components that can withstand hazardous liquids, liquids of various and/or changing viscosities, and can manage to pump fluids contaminated with solid matter. Accordingly, such pumps have various attributes that render them more desirable for use under operating conditions unsuitable for other pump devices.

As alluded to above, during operation of the dual diaphragm pump assemblies, air is ported through the air valve piston into a center block or air manifold assembly where two directional ports direct the air to the respective left-hand or right-hand sides of the diaphragm pump assembly. Such pumps have two liquid chambers, two air chambers, and two diaphragms. In each pair of chambers, the liquid or working fluid chambers and air chambers are separated or fluidly isolated from one another by the respective flexible diaphragms.

With respect the operating gas or air chamber side of the discrete diaphragm chambers, the air pressure is applied on the back side of one diaphragm forcing the product or working fluid out of the liquid chamber associated with the respective side of the pump assembly and into a fluid discharge manifold connected to the pump assembly. As the two diaphragms are connected by the rod, connecting rod, or shaft, the diaphragm opposite the current discharge stroke side of the pump assembly is pulled towards the center of the pump assembly as the opposite pump chamber undergoes a discharge stroke. Said in another way, the axial displacement associated with each discharge stroke causes an intake or a suction stroke on the other diaphragm pump chamber. Ball valves associated with the fluid intake passage and the fluid discharge passage of each discrete pump chamber alternately open and close the respective intake and discharge passages associated with the respective diaphragm chambers to fill the respective pump chambers and to prevent back flow of the working fluid into the discrete working fluid diaphragm chamber during the cyclic operation of the pump assembly.

At the end of the shaft stroke in each of the opposite axial directions, the air mechanism (air valve retracting diaphragm) automatically shifts the operational direction associated with the positive air pressure signal to the opposite side of the pump assembly thereby reversing the direction of the axial translation associated with the cyclic action of the pump.

Even though such pumps are robust, such dual pumping diaphragm pump assemblies are not without their drawbacks. Stalling of the operation of such dual pumping diaphragm pumps can be caused by insufficient pressure differentials between the fluid working side and the air chamber side of the respective pumping diaphragm chambers and/or unbalanced pressure differentials between the respective discrete intake and exhaust side fluid and air flow passages associated with the discrete, but operationally connected, pumping diaphragm chambers. Such assemblies can also be rendered inoperable or stall due to failure of one or more of the seals associated with the connecting rod or shaft associated with the air flow side of the discrete pumping diaphragm chambers. Failure of one of more of the connecting rod seals commonly results in insufficient air flow pressure signals being communicated to the respective air flow side of the respective diaphragm chambers thereby resulting in stalling of the cyclic operation of the underlying diaphragm pump assembly.

Many dual diaphragm reciprocating fluid pumps also produce what appears as a pressure surge or spike associated with the working fluid flow that is created during the reversal or changeover associated with the operating direction or the alternative axial translation of the control rod or connecting shaft and/or the respective diaphragms associated therewith. However, closer inspection has determined that the pressure spike is actually a pressure drop followed by a small pressure spike associated with the discharge of the working fluid flow.

Each time the pump reverses the axial operation direction, the operational air pressure is removed from the near empty or recently discharged working fluid chamber side of the pump assembly and is applied to the recently fluid filled pump chamber. As the pump operating air changes pump chambers, both pumping diaphragms, and the connecting rod associated therewith, change operational direction and the fluid output pressure reduces until the operating air adequately fills the alternate air chamber thereby increasing the fluid side pressure from a suction stroke pressure to an operating pressure and ultimately a pressure associated with effectuating a working fluid discharge stroke.

Devices downstream of the pump assembly can be sensitive to such pressure changes and some applications depend on more stable or steady state fluid flows to achieve a desired process. Recognizing the shortcomings associated with utilization of such pump assemblies, current methodologies rely upon supplemental devices, such as fluid flow surge suppressors or the like that are located upstream or downstream of dual pumping diaphragm pump assemblies to mitigate the undesirable pressure changes and to stabilize the fluid flow signal. Unfortunately, the pressure deviations associated with the working fluid flow can also be detrimental to the intended operation of such devices.

Such pressure vessels commonly include a housing that defines a pressure chamber and a surge chamber that are fluidly separated from one another by a fluid separating diaphragm. The pressure vessels provide a temporary pressure accommodation, such as a temporary pressure storage when the pump output pressure surges or the pump pressure spikes. Utilization of such methodologies increase the cost associated with the manufacture and installation of systems having such a pressure signal arresting device. Additionally, if the fluid material contains effluent or suspended particulate matter, such approaches are also more susceptible to plugging, increase system flushing difficulty, can result in assembly fracture if the pumped pressure exceeds rated values, detracts from maintenance efficiency due to wear and corrosion, and can lead to undesired operation of the underlying system due to reductions in the effectiveness of the system if the gas flow pressure is incorrect or lost. Accordingly, there is a need for a diaphragm pump system and method for accommodating the pressure signal deviations inherent to operation of dual pumping diaphragm pump assemblies and which mitigates the detriments associated with upstream and/or downstream fluid flow pressure manipulations such as the utilization of supplemental structures such as pressure vessels.

SUMMARY OF THE INVENTION

The present application discloses a diaphragm pump system and control arrangement that solves one or more of the shortcomings disclosed above. One aspect of the application discloses a diaphragm pump system that includes a pair of working fluid diaphragm pump assemblies that are each fluidly connected to a working fluid flow. Each working fluid diaphragm pump assembly is operationally associated with a discrete drive arrangement that is fluidly isolated from the working fluid flow that is moved during operation of the pump system. A control arrangement is connected to the discrete drive arrangements and configured to control the cyclic operation of the pair of working fluid diaphragm pump assemblies to mitigate pulsatile effects in the combined working fluid flow when the discharges of the working fluid flows associated with operation of the pair of working fluid diaphragm pump assemblies is combined.

Another aspect of the present application that is combinable or useable with one or more of the above aspects discloses a diaphragm pump system that includes a first pump assembly and a second pump assembly. Each pump assembly includes a housing, a working fluid pumping diaphragm that is disposed in the housing, and a shaft that is supported by the housing and attached to the working fluid pumping diaphragm such that the working fluid pumping diaphragm of each of the first pump assembly and the second pump assembly are independently operable relative to one another. An inlet manifold is fluidly connected to an inlet side of each of the first pump assembly and the second pump assembly. A discharge manifold is fluidly connected to a discharge side of each of the first pump assembly and the second pump assembly. A first diaphragm retracting assembly is connected to the first pump assembly and configured to manipulate operation of the shaft of the first pump assembly. A second diaphragm retracting assembly is connected to the second pump assembly and configured to manipulate operation of the shaft of the second pump assembly independent of the first diaphragm retracting assembly. A control arrangement is connected to the first diaphragm retracting assembly and the second diaphragm retracting assembly and is configured to oscillate operation of the working fluid pumping diaphragm of the first pump assembly and the second pump assembly to create a generally uniform discharge pressure associated with an outlet of the discharge manifold. Preferably, each of the retraction operation and the discharge operation associated with operation of the discrete pump assemblies is independently controllable such that an intake stroke associated with one working fluid pumping assembly does not adversely affect the working fluid flows associated with the second working fluid pump assembly.

A further aspect of the present application that is useable or combinable with one or more of the above aspects discloses a method of forming a diaphragm pump assembly. The method includes connecting a first working fluid pumping diaphragm pump assembly to a first diaphragm retracting assembly and connecting a second working fluid pumping diaphragm pump assembly to a second diaphragm retracting assembly that is independently operable relative to the first working fluid pumping diaphragm pump assembly. The first working fluid pumping diaphragm pump assembly and the second working fluid pumping diaphragm pump assembly are connected to a respective working fluid intake and a respective working fluid discharge. Operation of the first diaphragm retracting assembly and the second diaphragm retracting assembly is controlled to effectuate operation of the first working fluid pumping diaphragm pump assembly and the second working fluid pumping diaphragm pump assembly to balance a flow value and a pressure value associated with a combined output of the working fluid discharges.

Another aspect of the present application that is usable or combinable with one or more of the above features or aspects discloses a diaphragm pump system that includes a first working fluid diaphragm pump assembly and a second working fluid diaphragm pump assembly. Each of the first working fluid diaphragm pump assembly and the second diaphragm pump assembly include a respective diaphragm that is disposed in a respective working fluid diaphragm pump chamber. A first drive arrangement that is fluidly isolated from a working fluid flow is connected to the diaphragm of the first working fluid diaphragm pump assembly such that the first drive arrangement is operable to effectuate cyclic operation of the diaphragm of the first working fluid diaphragm pump assembly relative to the working fluid diaphragm pump chamber of the first working fluid diaphragm pump assembly. A second drive arrangement is also fluidly isolated from the working fluid flow and is connected to the diaphragm of the second working fluid diaphragm pump assembly. The second drive arrangement is operable to effectuate cyclic operation of the diaphragm of the second working fluid diaphragm pump assembly relative to the working fluid diaphragm pump chamber of the second working fluid diaphragm pump assembly. A control arrangement is connected to each of the first drive arrangement and the second drive arrangement and configured to control operation of the first working fluid diaphragm pump assembly and the second working fluid diaphragm pump assembly to create a steady state condition of a pressure and a flow of the working fluid discharged from the first working fluid diaphragm pump assembly and the second working fluid diaphragm pump assembly.

Another aspect of the present invention that is useable or combinable with one or more of the above aspects discloses a ball valve assembly that is associated with the working fluid flow associated with one or more of the working fluid diaphragm pump assemblies as disclosed above. The ball valve assembly includes a seat that is defined by a portion of the housing associated with working fluid diaphragm pump assembly. A seal is supported by the seat and oriented to engage the ball to selectively close the passage associated with the ball valve assembly when the ball is engaged therewith. In a preferred aspect, the ball includes a weight that is oriented to gravitationally bias the ball into engagement with the seal associated with the seat when desired.

These and other aspects, features, and advantages of the present invention will become apparent from the following detailed description, claims, and accompanying drawings.

DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

DETAILED DESCRIPTION OF THE PREFERRED EMBODIMENTS

Figure 1:
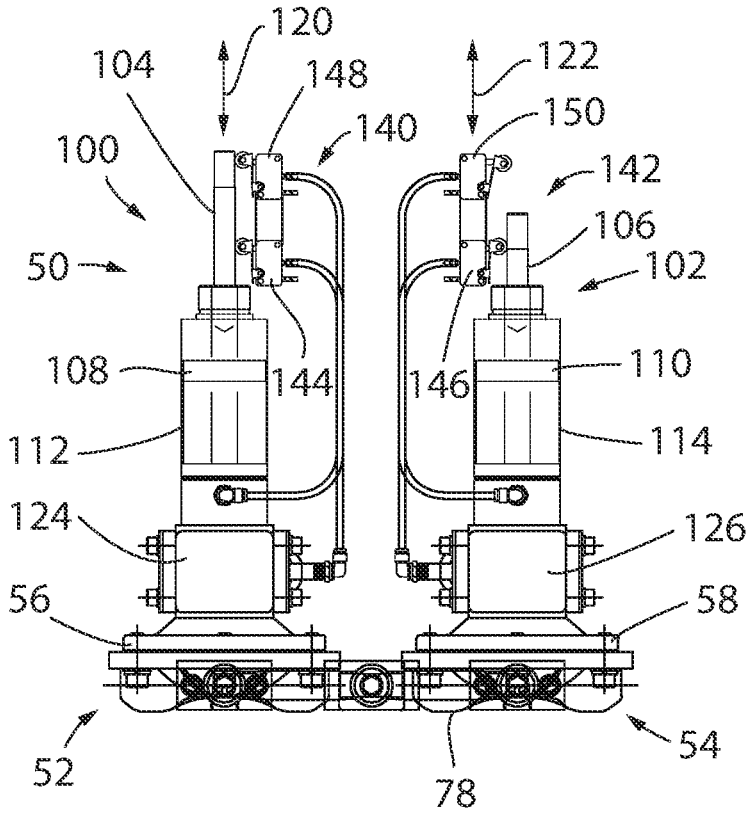
FIG. 1 is a top plan view of a portion of a diaphragm pump system according to one embodiment of the present invention.
Figure 2:
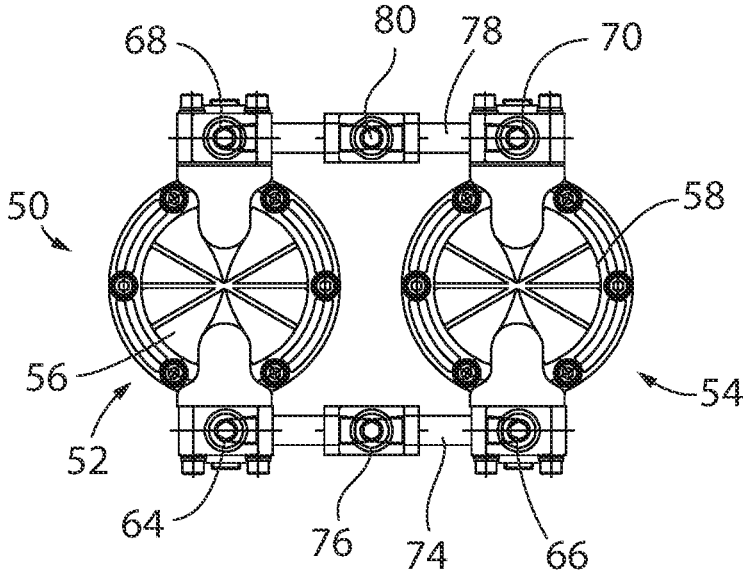
FIG. 2 is a front elevation view of the diaphragm pump system shown in FIG. 1.

Referring to FIGS. 1-2, a diaphragm pump system 50 according to a first embodiment of the present invention includes a first working fluid pumping diaphragm pump assembly 52 and a second working fluid pumping diaphragm pump assembly 54. Each working fluid pumping diaphragm pump assembly includes a respective working fluid pumping diaphragm pump housing 56, 58 that is constructed to enclose a respective working fluid pumping diaphragm as disclosed further below. As is commonly understood, translation of the respective working fluid pumping diaphragms in respective back and forth working directions effectuates the respective intake and discharge strokes associated with communicating a working fluid through the discrete diaphragm pump assemblies 52, 54. As used herein, reference to the respective working fluid diaphragm pump assemblies refers to the portions of system 50 wherein operation of the respective diaphragms associated therewith effectuate translation of the fluid intended to be moved via the cyclic operation of the respective diaphragms associated therewith.

The housing 56, 58 associated with each working fluid pumping diaphragm pump assembly 52, 54 defines a discrete working fluid inlet 64, 66 and a discrete working fluid outlet 68, 70. An inlet manifold 74 fluidly connects the inlets 64, 66 associated with respective diaphragm pump assemblies 52, 54 to a common working fluid inlet 76. Working fluid inlet 76 is constructed to be connected to a bulk fluid source that is intended to be moved by operation of diaphragm pump system 50. A working fluid outlet manifold 78 fluidly connects the respective outlets 68, 70 associated with discrete diaphragm pump assemblies 52, 54 to a common fluid outlet 80. During operation of the respective working fluid diaphragms 60, 62, fluid is drawn from manifold inlet 76 and directed toward the corresponding inlet 64, 66 of a respective working fluid pumping diaphragm pump assembly 52, 54 and associated with a respective intake stroke of a respective working fluid diaphragm. Once drawn into the working fluid chamber associated with each diaphragm pump assembly 52, 54, during a respective discharge stroke of a respective working fluid diaphragm, the working fluid is communicated to a respective outlet 68, 70 and therefrom toward manifold outlet 80. As disclosed further below, diaphragm pump system 50 is configured to provide a substantially uniform pressure and flow signal associated with the working fluid flow even though the resultant working fluid flow associated with discharge manifold 78 is created by combination of the discrete fluid flows associated with operation of respective discrete diaphragm pump assemblies 52, 54.

System 50 includes a first diaphragm retracting assembly or working fluid diaphragm pump operator 100 in the form of a piston assembly 100 and a second diaphragm retracting assembly or working fluid diaphragm pump operator 102 in the form of a second piston assembly 102 which are each discreetly associated with a respective working fluid diaphragm pump assembly 52, 54. Each piston assembly 100, 102 includes a piston shaft 104, 106 that is attached to a respective piston 108, 110 that is slideably disposed within a respective piston shaft 112, 114. Each respective piston 108, 110, and the corresponding piston shaft 104, 106 associated therewith, is slidable in an axial direction, as indicated by arrows 120, 122 to effectuate the discrete cyclic operation of the respective diaphragm 60, 62 of the underlying diaphragm pump assembly 52, 54.

An air manifold 124, 126 is disposed between respective diaphragm assemblies 52, 54 and a corresponding piston assembly 100, 102 and configured to effectuate the desired sequential or controlled operation of discrete diaphragm pump assemblies 52, 54 as described further below. Each piston assembly 100, 102 includes a respective limit control or piston position indication arrangement 140, 142 that cooperates with a respective piston shaft 104, 106. Arrangements 140, 142 provide an indication as to the relative position of the respective pistons 108, 110 and thereby an indication as to the relative position of the respective piston shaft 112, 114, and thereby an indication as to the relative operational position associated with the respective working fluid diaphragm pump assemblies 52, 54. Said in another way, arrangements 140, 142 provide an indication as to the relative intake and/or discharge stroke associated with the respective diaphragms associated with working fluid diaphragm assemblies 52, 54.

Figure 3:
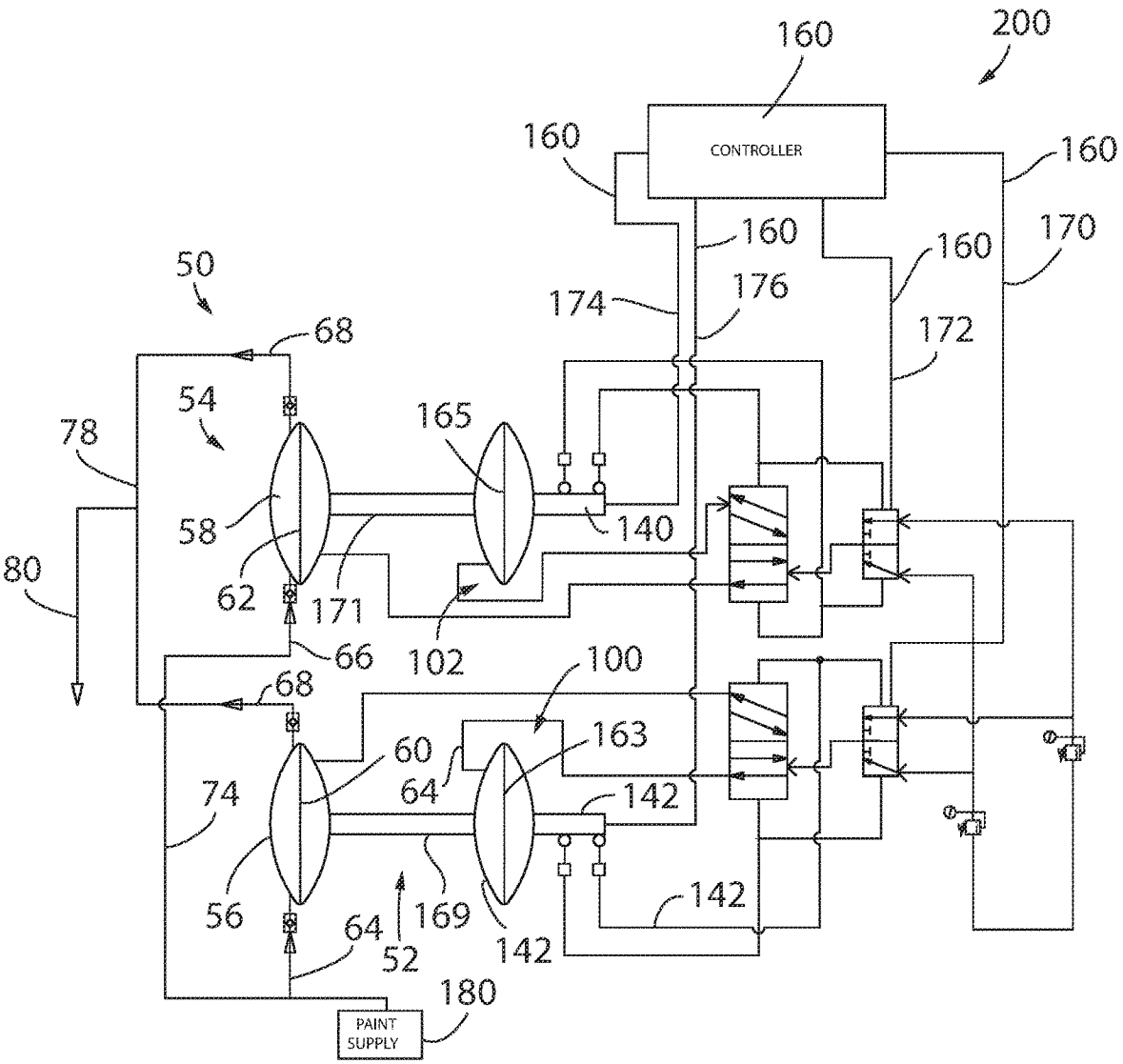
FIG. 3 is a schematic representation of a diaphragm pump system according to another embodiment of the invention.
Figure 4:
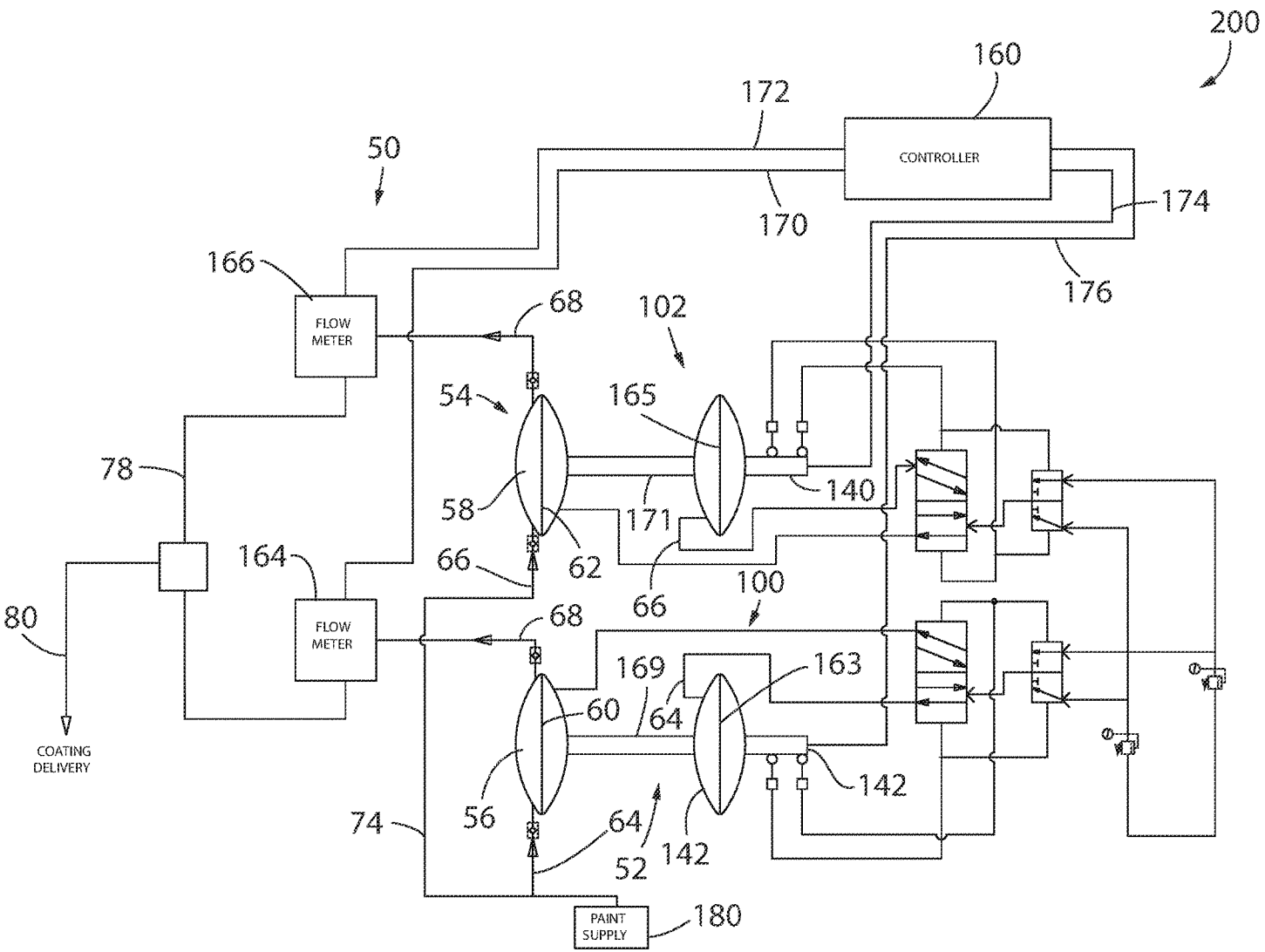
FIG. 4 is a schematic representation of another embodiment of the diaphragm pump system according to another embodiment of the invention.
Figure 5:
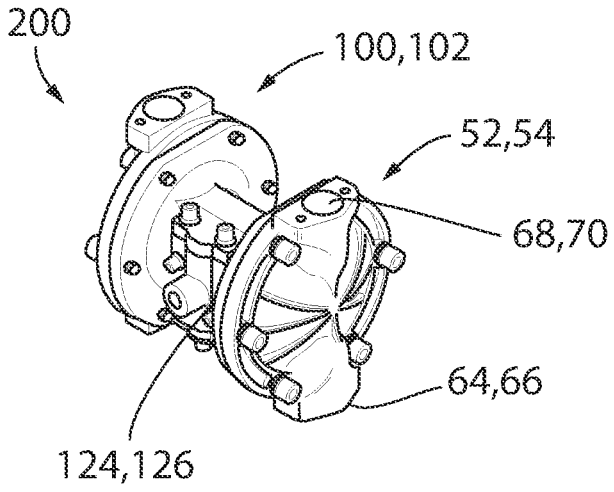
FIG. 5 is a perspective view of one of the working fluid diaphragm pump assemblies and respective working fluid diaphragm retracting assemblies of the diaphragm pump system shown in FIG. 4.
Figure 6:
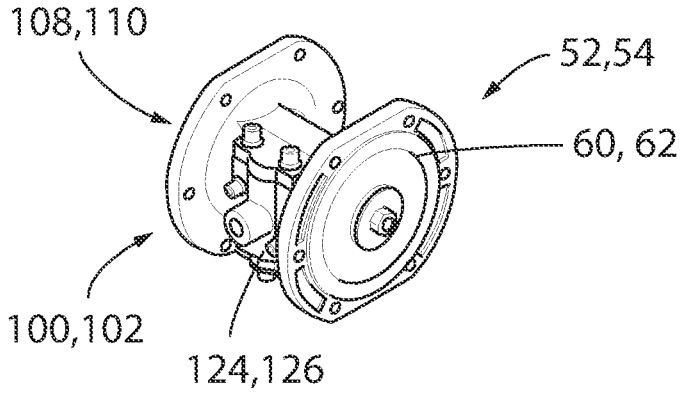
FIG. 6 is a view similar to FIG. 5 and shows a portion of the housing removed from the diaphragm pump system and exposing a diaphragm disposed therein.
Figure 7:
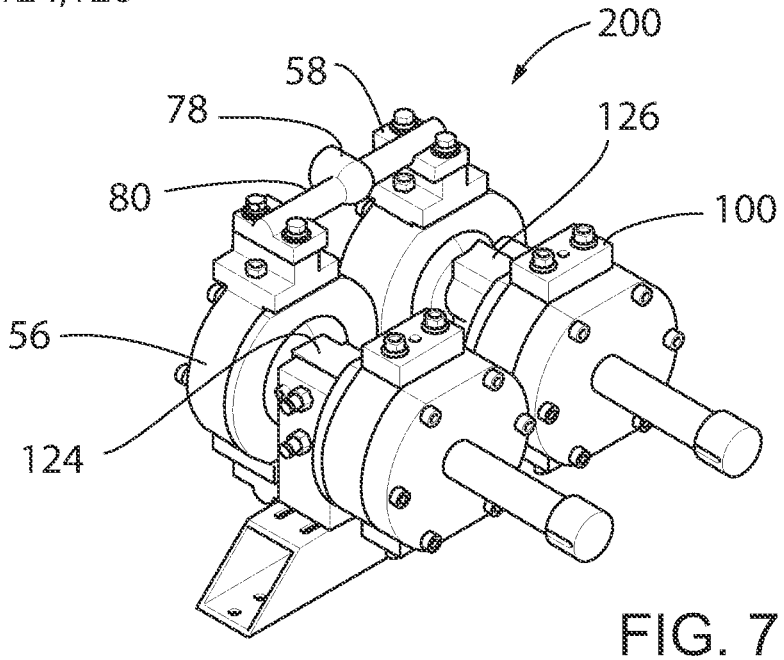
FIG. 7 is a perspective view of the working fluid and retracting diaphragm pump assemblies of the system shown in FIG. 4.

Referring to FIG. 1, in one embodiment, each limit switch assembly or control arrangement 140, 142 includes a first limit switch 144, 146 and a second limit switch 148, 150 that are configured to provide an indication as to the position of piston 108, 110 relative to the respective piston sleeve 112, 114. Such an indication is also indicative of an underlying position associated with operation of respective working fluid diaphragm associated with the respective working fluid diaphragm pump assemblies 52, 54. FIGS. 3 and 4 show a diaphragm pump system 200 according to another embodiment of the present invention. Similar reference numbers are used in FIGS. 1-10 to refer to similar structures between diaphragm pump system 50 and diaphragm pump system 200 and/or interchangeable features therebetween. As set forth further below, it is appreciated that various modalities of a control arrangement are possible and can be desirably configured to achieve the desired operation of a respective diaphragm system 50, 200 in accordance with one or more discrete features disclosed in the present application.

Referring to FIGS. 3-8, diaphragm pump system 200 preferably includes a control, controller, or control arrangement 160 having one or more inputs 162 and is connected to one or more sensors 164, 166 and/or limit switch assemblies or control arrangements 140, 142 associated with assessing the underlying operational condition of the respective working fluid diaphragm pump assemblies 52, 54 and the respective diaphragm retracting assemblies 100, 102 associated with the respective diaphragm pump system 50, 200.

Unlike system 50, diaphragm pump system 200 includes a first diaphragm retracting assembly or working fluid diaphragm pump operator 100 and a second diaphragm retracting assembly or working fluid diaphragm pump operator 102 that are formed as respective non-working fluid diaphragm pump assemblies. Said in another way, a respective diaphragm 163, 165 associated with the pump operators 100, 102 of system 200 are fluidly isolated from the working fluid flow associated with working fluid diaphragm pump assemblies 52, 54 but operationally connected thereto via respective connecting rods 169, 171 such that the cyclic operation of respective diaphragms 163, 165 effectuates the desired cyclic operation of diaphragms 60, 62 but do not directly effectuate movement of the working fluid flow during operation of system 200.

Like system 50, system 200 includes one or more connections 170, 172, 174, 176 that extend between one or more sensors 164, 166 and/or limit switch assemblies 140, 142 so as to provide the desired indication and/or communication of information associated with the desired operation of the underlying respective diaphragm pump system 50, 200. It is further appreciated that, depending on the configuration of the discrete sensors 164, 166 and/or limit switch assemblies and/or control arrangements 140, 142, inputs 170, 172, 174, 176 can be configured to communicate any of an electrical and/or pneumatic operational signals to controller 160 to achieve the desired cyclic operation of respective diaphragm pump assemblies 52, 54 to achieve a generally uniform flow volume and pressure of the working fluid output 80 associated with working fluid flow discharge manifold 78. As disclosed further below with respect to FIGS. 9 and 10, it is further appreciated that the operational functionality associated with the sensors 164, 166 can be provided in various modalities. Although shown as being associated with the working fluid diaphragm retracting assembly, it is further appreciated that the working fluid diaphragm retracting assemblies shown therein could be equivalently be formed as diaphragm retracting assemblies as disclosed above in FIGS. 3-4.

As shown schematically in FIGS. 3 and 4, diaphragm pump working fluid inlets 64, 66 are preferably fluidly connected to one another via intake or inlet manifold 74 which is fluidly connected to a bulk fluid source 180. It is appreciated that source 180 may take many forms such as a bulk container. As disclosed further below, it is envisioned that systems 50, 200 are usable in various environments. For instance, source 180 can be configured as an unpressurized source of bulk material. Although such tanks are commonly referred to in the industry as "pressure pots" wherein the volume of the tank is pressurized to effectuate communication of the bulk materials to the delivery system, there is no need to pressurize the source of bulk material when the same is communicated to an application device via respective systems 50, 200. Such a consideration provides for ready inspection of volume of material that remains available for use and allows for construction of the bulk container system in a lighter form factor in as much as the container is not subjected to pressurization. Systems 50, 200 are configured to be useable in both manual and automatic coating applications including automotive and equipment manufacturing painting operations, application of ultraviolet (UV) coatings such as in the manufacture of wood furniture, cabinets, auto lamp covers, metal furniture, application of ceramic coatings such as in mold making processes common to aerospace applications, application of porcelain coatings such as used in the manufacture and conditioning of bathroom fixtures, as well as the application of chemical agent resistant coatings (CARC) typical to military applications. It should be appreciated that the applications provided above are merely exemplary rather than exhaustive of the uses associated with systems 50, 200.

Regardless of the intended application, operation of respective working fluid diaphragms 60, 62, of systems 50, 200 in response to operation of the respective first and second working fluid diaphragm retracting assemblies 100, 102, whether formed as a piston operational modality, as in system 50, or a diaphragm operational modality, as in system 200, effectuates communication of the working fluid flow from respective inlets 64, 66, to respective discharges 68, 70, and therefrom to the common working fluid flow discharge outlet 80 associated with discharge manifold 78. The sequential operation of working fluid diaphragms 60, 62 associated with generation of the respective discharge strokes is effectuated by operation of respective pistons 108, 110 associated with piston assemblies 102, 104 of system 50 or operation of the respective non-working fluid diaphragms 163, 165 in response to the various pressure and fluid flow signals associated with the controlled operation of the respective diaphragm pump system 50, 200.

Figure 9:
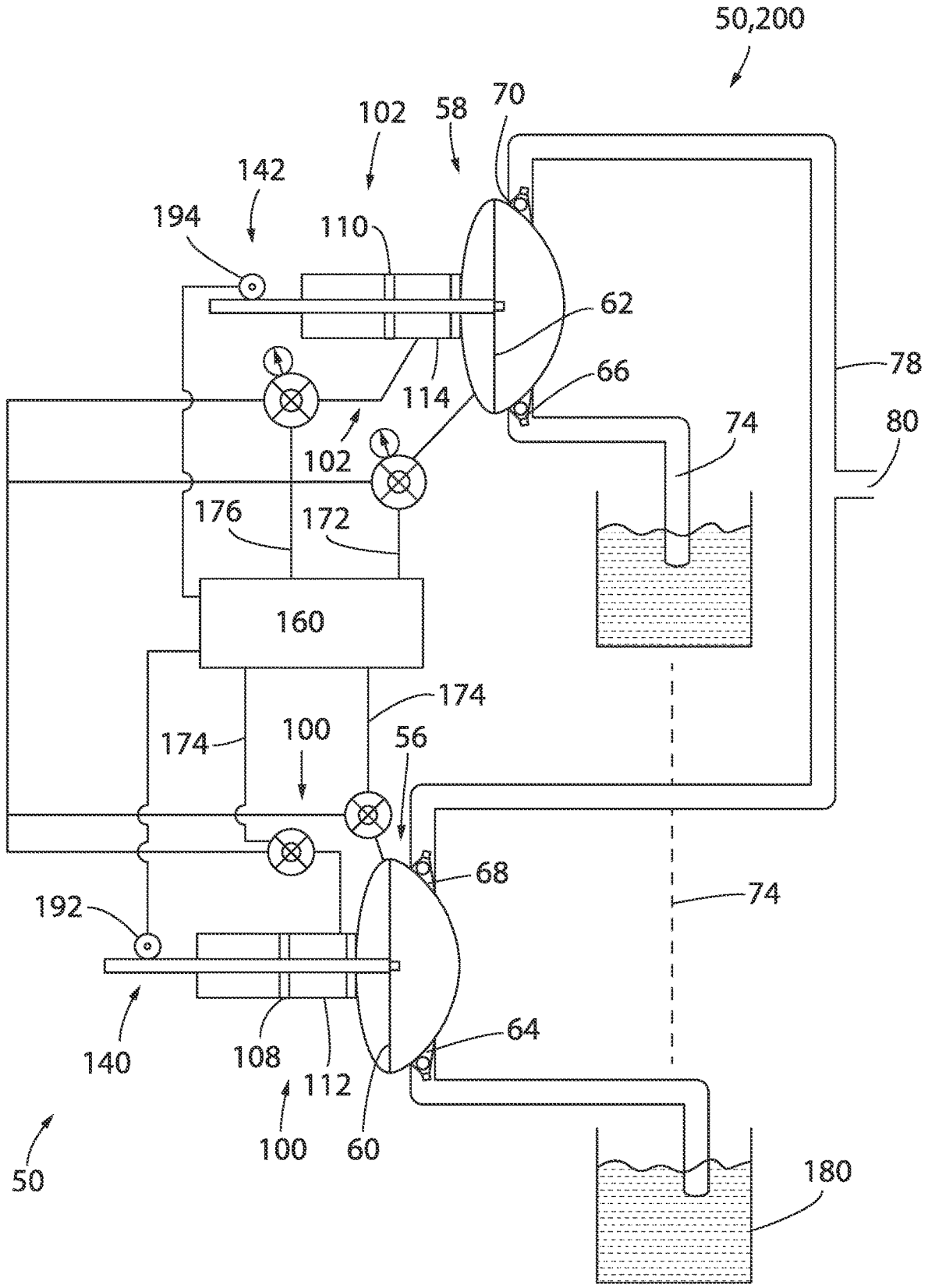
FIG. 9 is a schematic view of the diaphragm pump system shown in FIG. 1 with an alternate diaphragm position detection system according to a further aspect of the present invention.

In an alternate aspect as shown in FIG. 9, limit or position switches 140, 142 associated with the respective position of piston shaft 104, 106 are further provided as a gear limit arrangement 192, 194 associated with providing and/or ascertaining the desired or actual relative axial position of respective pistons 108, 110 relative to respective cylinders 112, 114. Like limit switch assemblies 140, 142, it is further appreciated that gear position indicators 192, 194 be operationally connected to controller 160 so as to provide the desired indication as to the relative position of respective pistons 108, 110 relative to the underlying diaphragm piston pump assemblies 52, 54.

Figure 10:
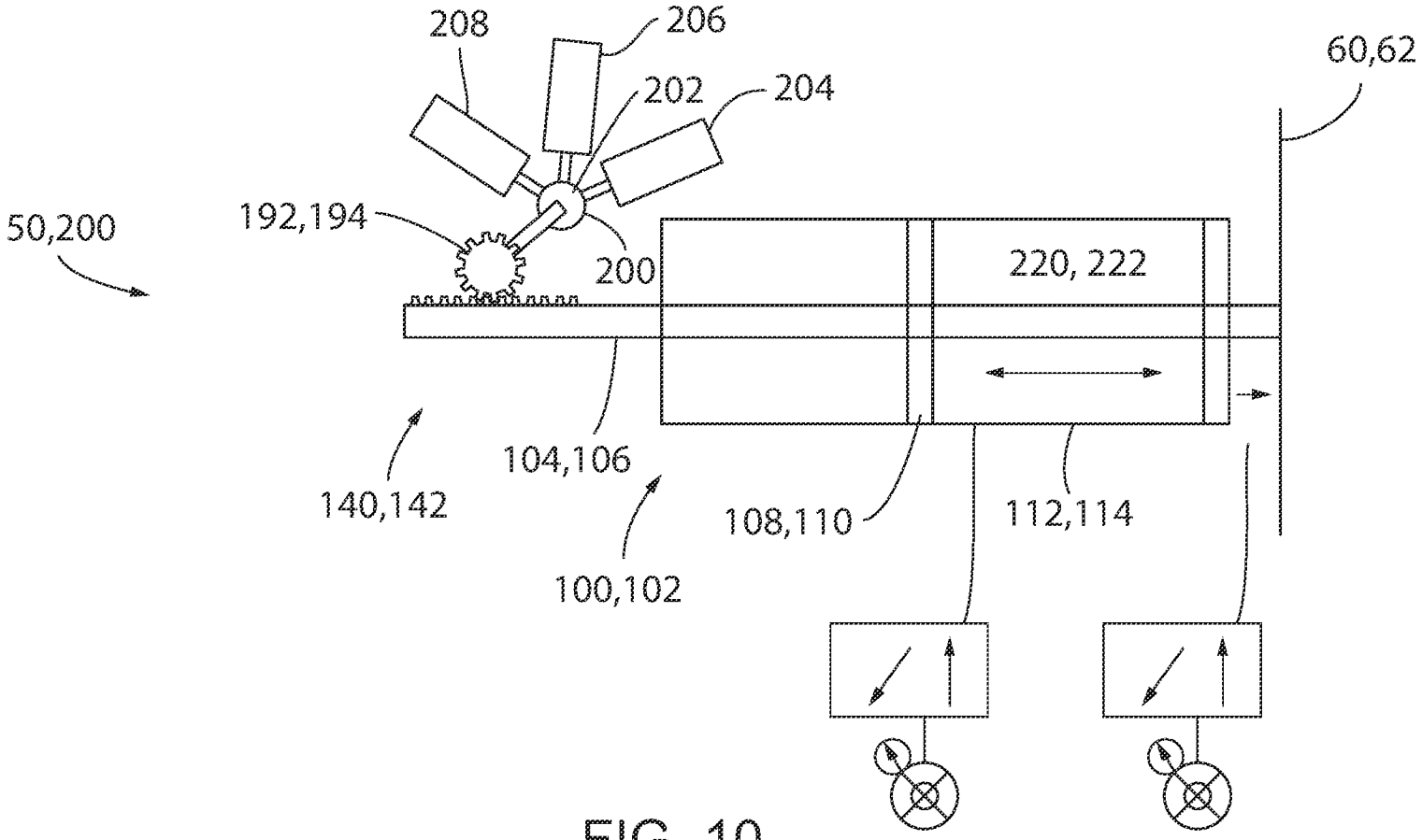
FIG. 10 is a view similar to FIG. 9 and shows another alternate diaphragm position detection system associated to another aspect of the present invention.

Referring to FIG. 10, when provided in a gear driven arrangement, it is further appreciated that respective limit assemblies 140, 142 can include a cam arrangement 201 having one or more lobes 202 that are configured and oriented to interact with one or more axial limit switches 204, 206, 208. The relative position and/or signal associated with switches 204, 206, 208 provides an indication as to the relative orientation of respective piston shaft 104, 106, and the respective piston 108, 110 associated therewith, relative to the corresponding cylinder 112, 114, and thereby a current operating condition associated with a respective working fluid diaphragm 60, 62.

Each of the limit or position indicating configurations disclosed above provides an indication as to the relative orientation associated with a respective diaphragm 60, 62 relative to the respective intake and/or discharge stroke associated therewith. During operation of diaphragm pump systems 50, 200, respective operational instructions are communicated to the chamber associated with a dry, air, or non-working fluid side of respective diaphragm 60, 62 and/or a respective pressure chamber 220, 222 associated with respective piston assemblies 100, 102 so as to effectuate the desired cyclic operation of respective diaphragm 60, 62 at least in part in response to the operating pressure associated with the discharge flow and/or pressure associated with the working fluid flow moved via operation of the respective diaphragm pump system 50, 200.

It is appreciated that the cyclic operation associated with each of discrete pistons 108, 110 or diaphragms 163, 165 associated with the respective working fluid diaphragm retracting assembly can be effectuated with either of a pressure or vacuum signal being communicated to the laterally outboard facing side or the diaphragm facing side associated with each of pistons 108, 110 or non-working fluid diaphragms 163, 165. That is, it is appreciated that a vacuum pressure signal or a position pressure instruction signal can be communicated to a desired respective side of each of respective pistons 108, 110, the non-working fluid side of diaphragm 60, 62, and/or a respective side of non-working fluid diaphragms 163, 165 to achieve the desired intake or discharge stroke of a respective working fluid diaphragm 60, 62.

As disclosed further below with respect to FIG. 11, the respective intake and discharge strokes associated with the operation of diaphragms 60, 62 is effectuated in such a manner so as to generally balance the working fluid pressure and flow characteristics associated with common working fluid output or outlet 80 of discharge manifold 78. The cyclic sequential operation associated with operation of diaphragm assemblies 52, 54 is configured to mitigate pressure and flow spikes associated with respective differentials between the working fluid intake and discharge flows and pressures in response to the sequential operation attributable to the contribution of the discrete diaphragm pump assembly 52, 54 to the resultant overall working fluid flow. That is, diaphragm pump systems 50, 200 are constructed to accommodate and mitigate the fluid flow pressure deviations associated with the cyclic nature innate to the operation of diaphragm pump assemblies 52, 54 wherein each of the discrete diaphragm chambers are associated with translating the working fluid flow through the respective diaphragm pump assembly.

As disclosed further below, the operation of controller 160 that operates to reduce the fluid pressure surges associated with the cyclic operation of diaphragms 60, 62. Referring to FIG. 11, control arrangement 160 is configured to briefly apply a pumping pressure or partial air pressure signal to both of dry side chambers at the same time near the full compression stroke associated with the discharge stroke of each respective diaphragm 60, 62. As disclosed further below with respect to FIG. 11, discrete diaphragm pump assemblies 52, 54, whether the operation is driven by a piston assembly or non-working fluid diaphragm assembly, whose position is monitored via a LVDT sensor or other sensor construction, are constructed to accommodate introduction of an operating air pressure flow, or a portion thereof, concurrently for a brief period, or overlap when one working fluid diaphragm approaches an end of a discharge stroke and the other working fluid diaphragm approaches an end of the intake stroke.

Figure 11:
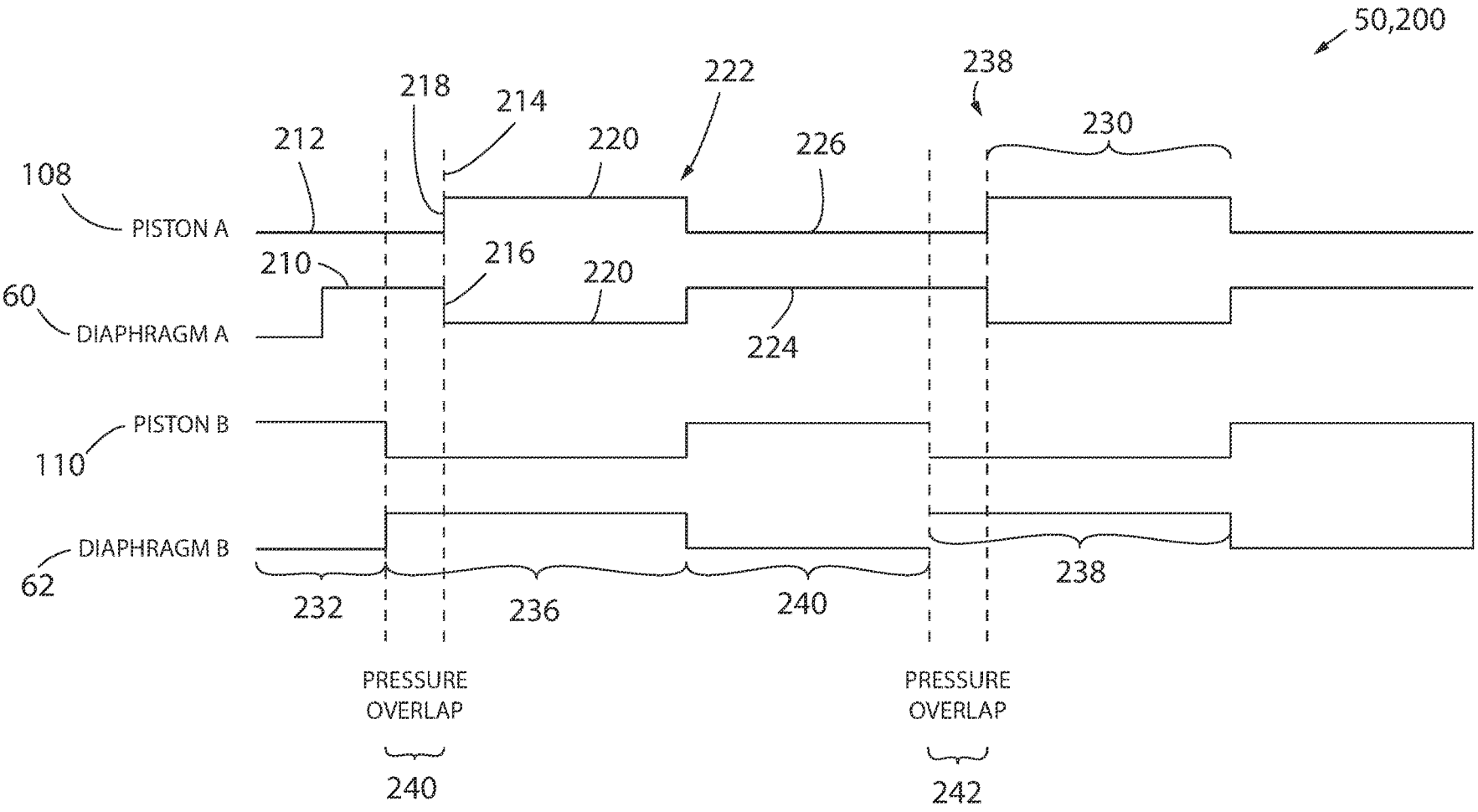
FIG. 11 is a trend plot showing the cyclic operation associated with the first working fluid diaphragm pump assembly and the second working fluid diaphragm pump assembly generated during the operation of the diaphragm pump assemblies show in the FIGS. above.
Figure 12:
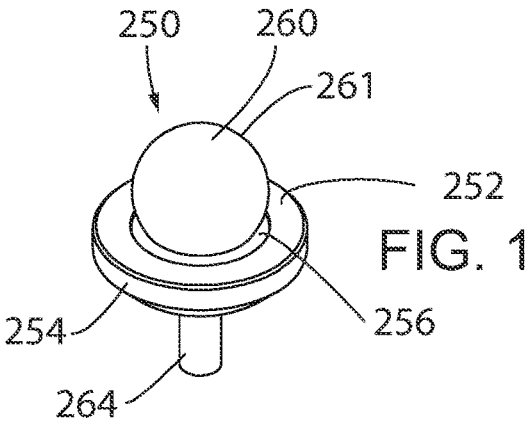
FIG. 12 is a perspective view of a ball valve assembly usable with the diaphragm pump assemblies disclosed above.
Figure 13:
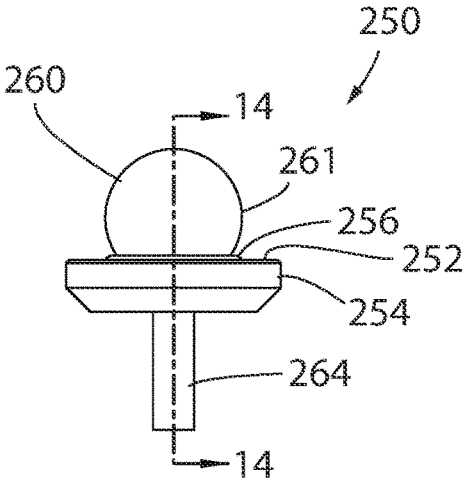
FIG. 13 is a side elevation view of the ball valve assembly shown in FIG. 12.
Figure 14:
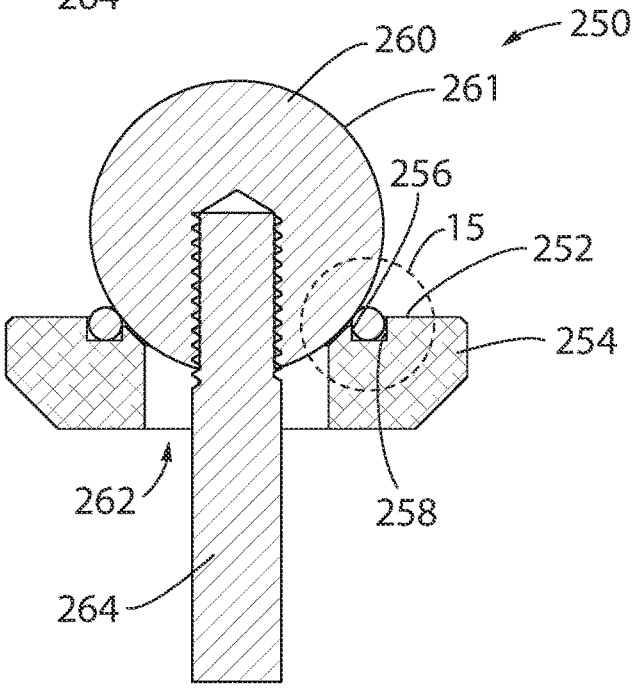
FIG. 14 is an elevational cross section view along line A-A of the ball valve assembly shown in FIG. 13.
Figure 15:
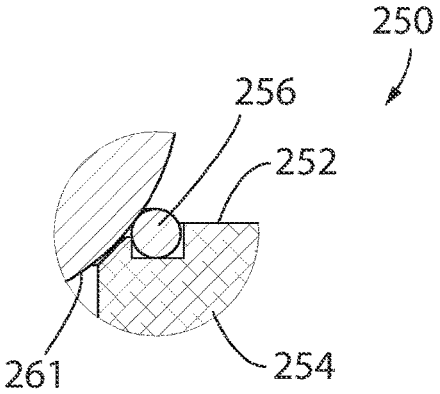
FIG. 15 is a detailed cross section view of the ball valve assembly taken along line B shown in FIG. 14.
Figure 16:
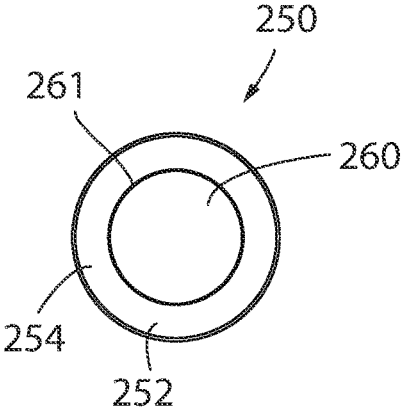
FIG. 16 is a top plan view of the ball valve assembly shown in FIG. 12.

FIG. 11 shows an exemplary operating sequence associated with control of the operation airflow to achieve the desired sequential cyclic operation associated with diaphragm pump system 50, 200. Communication to the air side of diaphragm 60 effectuates a discharge operation associated with diaphragm 60 and translation of piston 108, 212, or a respective non-working fluid diaphragm 163, 165 toward the working fluid side associated with diaphragm 60. Upon completion of the discharge stroke associated with diaphragm 60, 214, communication of the signal associated with nonworking fluid side of diaphragm 60, 216 terminates when an intake instruction 218 is communicated to piston 108 or the respective non-working fluid diaphragm 163, 165 to effectuate an intake stroke 220 associated with diaphragm 60 and piston 108 or a respective non-working fluid diaphragm 163, 165.

Upon completion of the intake stroke 222 associated with operation of non-working fluid diaphragm 165 or piston 108 and diaphragm 60, discharge stroke instructions 224, 226 associated with diaphragm 60 and piston 108, or non-working fluid diaphragm 165, are initiated until initiation 228 of a discharge stroke 230 of diaphragm 60 and associated piston 108 or diaphragm 165. Operation of diaphragm 62 and piston 110, or diaphragm 165, are effectuated in a similar but timewise shifted or offset manner so as to effectuate multiple intake operations 232, 234 and multiple sequential discharge operations 236, 238 associated with operation of diaphragm 62 and piston 110 or diaphragm 163. That is, the discharge strokes associated with operation of diaphragms 60, 62 are timewise offset from one another so as to generate a generally uniform working fluid flow discharge pressure and flow parameters.

Multiple pressure signal overlap areas 240, 242 are provided at the discrete intervals during the cyclic operation of diaphragm 62 and piston 110 or non-working fluid diaphragm 163 and diaphragm 60 and piston 108 or non-working fluid diaphragm 165. Pressure overlaps 240, 242 associated with operation of diaphragms 60, 62 and pistons 108, 110, or non-working fluid diaphragms 163, 165 allows transitioning of each of the respective diaphragms 60, 62 during the respective intake and discharge strokes so as to maintain a generally uniform working fluid discharge flow and pressure associated with the cyclic operation of diaphragm pump system 50, 200 such that system 50, 200 mitigates the flow and pressure spikes associated with the discrete intake and discharge strokes inherent to operation of discrete ones of diaphragms 60, 62 during continued operation of system 50, 200.

Figure 8:
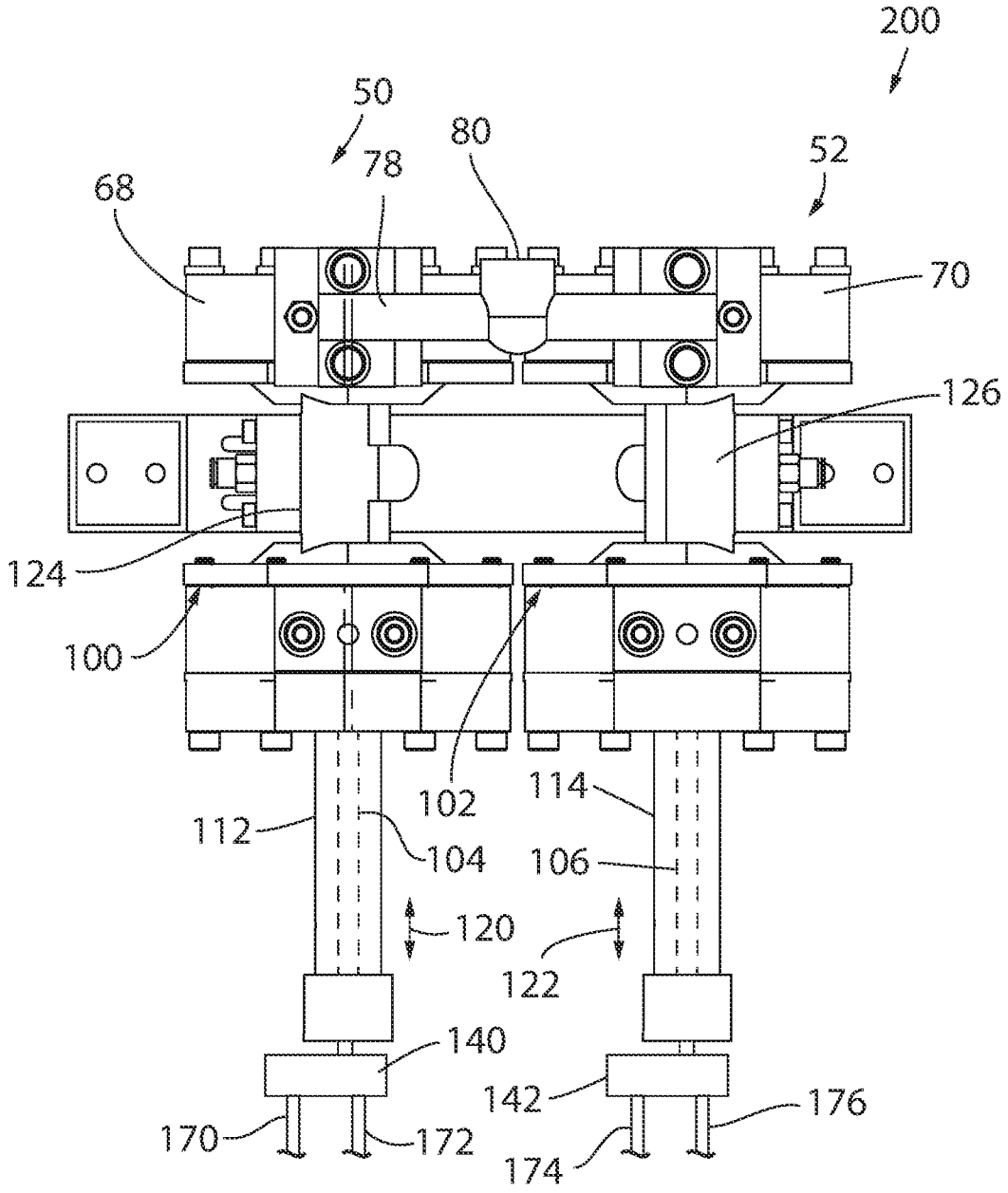
FIG. 8 is a top plan view of the working fluid and retracting diaphragm pump assemblies shown in FIG. 7.

It should be appreciated that although first and second working fluid diaphragm retracting operator or assembly 100, 102 are provided as respective diaphragm assemblies rather than piston assemblies as described above with respect to FIGS. 1-2, the respective diaphragm assemblies associated with the first and second working fluid diaphragm retracting pump operator or assembly 100, 102 as shown in FIGS. 3-8 are fluidly isolated from communication of the working fluid flow through system 200 and are each operable to effectuate manipulation of the respective working fluid diaphragm 60, 62. Referring to FIG. 8, each diaphragm retracting assembly 100, 102 includes a retracting diaphragm shaft 104, 106 that is attached to a respective retracting diaphragm 108, 110 that is slideably disposed within a respective retracting diaphragm shaft 112, 114. Each respective retracting diaphragm 108, 110, and the corresponding retracting diaphragm shaft 104, 106 associated therewith, is slidable in an axial direction, as indicated by arrows 120, 122 to effectuate the discrete cyclic operation of the respective working fluid pumping diaphragm 60, 62 of the underlying working fluid pumping diaphragm pump assembly 52, 54.

An air manifold 124, 126 is disposed between respective working fluid pumping diaphragm assemblies 52, 54 and a corresponding respective retracting diaphragm assembly 100, 102 and configured to effectuate the desired sequential or controlled operation of discrete pumping diaphragm pump assemblies 52, 54 as described above and described further below. Each retracting diaphragm assembly 100, 102 includes a respective limit control or retracting diaphragm position indication arrangement 140, 142 that cooperates with a respective retracting diaphragm shaft 104, 106. Position indication arrangements 140, 142 provide an indication as to the relative position of the respective retracting diaphragms 108, 110 and thereby an indication as to the relative position of the respective retracting diaphragm shaft 112, 114, and thereby an indication as to the relative operational position associated with the respective pumping diaphragm pump assemblies 52, 54. Said in another way, position indication arrangements 140, 142 provide an indication as to the relative intake and/or discharge stroke associated with operation of the respective working fluid pumping diaphragms 60, 62.

Position indication arrangements 140, 142 are constructed to communicate and control operation of working fluid pumping diaphragm pump assemblies 52, 54 and retracting diaphragm assemblies 100, 102 in the same manner as described above with respect to diaphragm pump system 50. As described above, each limit switch assembly or control arrangement 140, 142 includes a first limit switch and a second limit switch that are configured to provide an indication as to the position associated with the respective operation and position of retracting diaphragm 108, 110 relative to a respective retracting diaphragm sleeve 112, 114. Such an indication is also indicative of an underlying position associated with operation of respective working fluid pumping diaphragm 60, 62.

Although not shown in FIGS. 5-8, the diaphragm pump system 200 shown therein includes a control or control arrangement 160 as described above having one or more inputs and is connected to one or more sensors and/or limit switch assemblies or control arrangements 140, 142 associated with assessing the underlying operational condition of the respective working fluid pumping diaphragm pump assemblies 52, 54 and the respective retracting diaphragm assemblies 100, 102. One or more connections 170, 172, 174, 176 extend between one or more sensors and/or limit switch assemblies 140, 142 so as to provide the desired indication and/or communication of information associated with the desired operation of the underlying diaphragm pump system 50. It is further appreciated that, depending on the configuration of the discrete sensors and/or limit switch assemblies and/or control arrangements 140, 142, inputs 170, 172, 174, 176 can be configured to communicate any of an electrical and/or pneumatic operational signals to controller 160 to achieve the desired cyclic operation of respective working fluid pumping diaphragm pump assemblies 52, 54 to achieve a generally uniform flow volume and pressure of the working fluid output 80 associated with working fluid flow discharge manifold 78 in a manner similar to that described above with respect to FIGS. 1-6.

Like the arrangement shown schematically in FIGS. 1-2, the working fluid diaphragm pumps associated with diaphragm pump system 200 shown in FIGS. 3-8 include working fluid inlets that are fluidly connected to one another via an intake manifold which is fluidly connected to a bulk fluid source. Operation of respective working fluid pumping diaphragms 60, 62 in response to operation of respective retracting diaphragm assemblies 100, 102 effectuates communication of the working fluid flow from respective inlets to respective outlets associated with respective working fluid diaphragm pump assemblies 52, 54, and therefrom to the common working fluid flow discharge outlet 80 associated with discharge manifold 78. The sequential operation of working fluid pumping diaphragms associated with generation of the respective discharge strokes is effectuated by operation of respective retracting diaphragms 108, 110 associated with retracting diaphragm assemblies 102, 104 in response to the various pressure and fluid flow signals associated with the controlled operation of diaphragm pump system 50. It is appreciated that operation of the embodiment of the diaphragm pump system shown in FIGS. 3-8 is operable with either of the displacement and control arrangements 140, 142, 160 as described above to achieve the desired cyclic operation of working fluid pumping diaphragm assemblies 52, 54 as shown in FIGS. 3-8 wherein motion of the discrete working fluid diaphragms 60, 62 is provided by operation of the respective retracting diaphragm assemblies 100, 102 and the respective retracting diaphragm shafts 104, 106 associated therewith.

Each of the limit or position indicating configurations disclosed above provides an indication as to the relative orientation associated with a respective working fluid pumping diaphragms 60, 62 relative to the respective intake and/or discharge stroke associated therewith. With respect to the embodiment of diaphragm pump system 200 as shown in FIGS. 3-8, during operation of diaphragm pump assembly 200, respective operational instructions are communicated to the chamber associated with a dry, air, or non-working fluid side of respective working fluid pumping diaphragm 60, 62 and/or a respective pressure chamber 220, 222 associated with respective retracting diaphragm assemblies 100, 102 so as to effectuate the desired cyclic operation of respective working fluid pumping diaphragm 60, 62 at least in part in response to the operating pressure associated with the discharge flow and/or pressure associated with the working fluid flow moved via operation of diaphragm pumping system 200.

It is appreciated that the cyclic operation associated with each of discrete retracting diaphragms 108, 110 can be effectuated with either of a pressure or vacuum signal being communicated to the laterally outboard facing side or the working fluid pumping diaphragm facing side associated with each of retracting diaphragms 108, 110. That is, it is appreciated that a vacuum pressure signal or a position pressure instruction signal can be communicated to a desired side of each of respective retracting diaphragms 108, 110 and/or the non-working fluid side of the working fluid pumping diaphragm 60, 62 to achieve the desired intake or discharge stroke of a respective working fluid pumping diaphragm 60, 62.

As disclosed above with respect to FIG. 10, and with respect to the embodiment of system 200 shown in FIGS. 3-8, it is appreciated that the respective intake and discharge strokes associated with the operation of working fluid pumping diaphragms 60, 62 is effectuated in such a manner so as to generally balance the working fluid pressure and flow characteristics associated with common working fluid output 80 of discharge manifold 78. The cyclic sequential operation associated with operation of diaphragm pump assemblies 50, 52 is configured to mitigate pressure and flow spikes associated with respective differentials between the working fluid intake and discharge flows and pressures in response to the sequential operation attributable to the contribution of the discrete pump assembly 52, 54 to the resultant overall working fluid flow. That is, diaphragm pump systems 50, 200 are each constructed to accommodate and mitigate the fluid flow and fluid flow pressure deviations associated with the cyclic nature innate to the operation of diaphragm pump assemblies 52, 54 as disclosed above.

As alluded to above, the operation of controller 160 associated with the diaphragm pumping system 200 shown in FIGS. 3-8 also operates to reduce the fluid pressure surges associated with the cyclic operation of working fluid flow pumping diaphragms 60, 62. Referring to FIG. 10, control arrangement 160 associated with system 200 shown in FIGS. 3-8 is configured to briefly apply a pumping pressure or partial air pressure signal to both of the respective dry side chambers at the same time near the full compression stroke associated with the discharge stroke of each respective working fluid pumping diaphragm 60, 62. Discrete diaphragm pump assemblies 52, 54 are constructed to accommodate introduction of an operating air pressure flow, or a portion thereof, concurrently for a brief period, or overlap when one working fluid pumping diaphragm approaches an end of a discharge stroke and the other working fluid pumping diaphragm approaches an end of the intake stroke.

FIG. 10 shows an exemplary operating sequence associated with airflow control to achieve the desired sequential cyclic operation associated with working fluid pumping diaphragm pump system 50, 200. Communication to the air side of working fluid pumping diaphragm 60 effectuates a discharge operation associated with working fluid pumping diaphragm 60 and translation of retracting diaphragm 108, 212 toward the working fluid side associated with working fluid pumping diaphragm 60. Upon completion of the discharge stroke associated with working fluid pumping diaphragm 60, 214, communication of the signal associated with nonworking fluid side of working fluid pumping diaphragm 60, 216 terminates when an intake instruction 218 is communicated to retracting diaphragm 108 to effectuate an intake stroke 220 associated with working fluid pumping diaphragm 60 and retracting diaphragm 108.

Upon completion of the intake stroke 222 associated with operation of retracting diaphragm 108 and working fluid pumping diaphragm 60, discharge stroke instructions 224, 226 associated with working fluid pumping diaphragm 60 and retracting diaphragm 108 are initiated until initiation 228 of a discharge stroke 230 of working fluid pumping diaphragm 60 and associated retracting diaphragm 108. Operation of working fluid pumping diaphragm 62 and retracting diaphragm 110 are effectuated in a similar but timewise shifted or offset manner so as to effectuate multiple intake operations 232, 234 and multiple sequential discharge operations 236, 238 associated with operation of working fluid pumping diaphragm 62 and retracting diaphragm 110. That is, the discharge strokes associated with operation of working fluid pumping diaphragms 60 and timewise offset or shift relative to one another so as to generate a generally uniform working fluid flow discharge.

As shown in FIG. 10, multiple pressure signal overlap areas 240, 242 are provided at the discrete intervals during the cyclic operation of working fluid pumping diaphragm 62 and retracting diaphragm 110 and working fluid pumping diaphragm 60 and retracting diaphragm 108, respectively. Pressure overlaps 240, 242 associated with operation of working fluid pumping diaphragms 60, 62 and retracting diaphragms 108, 110 allows transitioning of each of the respective working fluid pumping diaphragms 60, 62 during the respective intake and discharge strokes so as to maintain a generally uniform working fluid discharge flow and flow pressure associated with the cyclic operation of working fluid pumping diaphragm pump system 200 such that system 200 mitigates the flow and pressure spikes associated with the discrete intake and discharge strokes inherent to operation of discrete ones of working fluid pumping diaphragms 60, 62 during continued operation of system 200 and/or for those configurations wherein the working fluid pumping diaphragms are physically connected to one another such that operation of one working fluid pumping diaphragm is physically contingent upon operation of an opposing working fluid pumping diaphragm.

It should further be appreciated that system 200 as disclosed in FIGS. 3-8 can be conveniently provided by manipulation of the construction of what is considered two discrete double working fluid diaphragm pump assemblies. However, as disclosed above, it should be further appreciated that only one discrete side of each double diaphragm pump assembly is associated with the communication of the working fluid flow through system 200. Such considerations present several novel aspects as to the control and operation of the underlying system.

For instance, the retraction speed associated with operation of retracting diaphragm assemblies 100, 102 determines the suction pressure and volume loaded into the working fluid diaphragm pumps 52, 54. In one embodiment, the linear variable differential transformer (LVDT) 140, 142 incorporates a LVDT transducer which provides controller 160 with an analog travel measurement. The measure of travel over time is used by controller 160 to determine speed and flow rate associated with operation of diaphragm pump assemblies 52, 54. Air pressure associated with driving the retraction rate associated with operation of retracting diaphragm assemblies 100, 102 is programmable such that system 200 can be configured to provide a constant retraction rate associated with retracting diaphragm assemblies 100, 102 and thereby working fluid pumping diaphragms 60, 62. Preferably, the speed of retraction associated with operation of the retracting diaphragm assemblies 100, 102 is controlled independently of the speed associated with the working fluid discharge stroke associated with each of the respective working fluid diaphragm pump assemblies. Such a consideration allows control of the retraction or working fluid pump load speed at a constant rate to allow optimization of the discrete working fluid load volumes. Similar considerations provide for control of the working fluid flow rates associated with combined contributions of the discrete working fluid flow diaphragm pump assemblies.

Whether provided as a piston retraction control arrangement or a diaphragm retraction control arrangement, working fluid pumping diaphragms 60, 62 includes some degree of hysteresis associated with the operation of the working fluid pumping diaphragm during each of the working fluid intake and discharge strokes. Accordingly, the pressure required to generate a constant or steady state working fluid flow rate as related to a current stroke condition changes with travel. Controller 160, LVDT 140, 142, and the programmable pneumatic pressure instructions provide a more constant or steady state working fluid delivery rate through adjustment, usually an increase, to the drive pressure as the respective working fluid pumping diaphragm 60, 62 approaches the respective ends of their respective operating strokes.

In a further aspect, systems 200 as disclosed above mitigates instances of reduced working fluid flow rates attributable to inadequate sealing or seating of the check valves associated with the discrete working fluid discharge strokes. During operation with low working fluid output pressures, failure of a discrete check valve associated with respective working fluid flow diaphragm 60, 62 to adequately seal can create a situation wherein a portion of the working fluid discharge flow is contributed to the volume associated and, although the system does not achieve a desired flow rate, the underlying working fluid pumping diaphragm pump assembly continues cyclic operation. Using an activate signal, such as actuation of a spray gun or the like associated with the discharge 80 of manifold 78 allows controller 160 can monitor LVDT's 140, 142 and provide a "check valve leak" signal or automatically reduce a respective pump assemblies 52, 54 compressed air pressure signal until working fluid pumping stops thereby automatically correcting the discharge check valve blow-by or bleed flows.

Accordingly, systems 50, 200, whether configured in accordance with the aspects shown in FIGS. 1-2 or the aspects shown in FIGS. 3-8, provides a diaphragm pump control arrangement having a more universal flow and pressure signal indicia associated with the cyclic operation of the underlying system 50, 200. Whereas pumping diaphragms 60, 62 provide the fluid pressure signal associated with operation of system 50, 200, respective retracting piston and diaphragm retracting diaphragm assemblies 100, 102 provide a pump suction speed associated with determining the pump volumetric output. Discrete pneumatic control of the working fluid pumping diaphragm operating air pressure and retracting piston or diaphragm suction pressure, and the timed pneumatic sequence associated therewith, provides for a selective overlap of the piston and/or diaphragm operating pressure when shifting between the intake and discharge strokes associated with operation of working fluid pumping diaphragm 60 and working fluid pumping diaphragm 62, respectively. The discrete overlap associated with respective pressure signals 240, 242 reduces flow and pressure value pulsatile effects associated with the discharge flow and pressure signal associated with the working fluid flow such that system 50, 200 provides dynamic control of both the suction and pressure speed control associated therewith. Further, each of systems 50, 200 negates the need for refilled and non-recirculated pressure potentiometers as well as fluid flow surge suppressors and/or pressure regulators commonly associated with fluid pump output ports thereby providing a generally robust system having fairly negligible flow surge signals during operation.

FIGS. 12-16 show various views of an optional ball valve assembly 250 usable with at least one, and preferably each, of the respective intake and discharge ports associated with the respective working fluid diaphragm assemblies 52, 54 associated with systems 50, 200. Those skilled in the art will readily appreciate the construction of ball valve assemblies 250 as being commonly disposed between at least one of an inlet passage and a discharge passage between the discrete diaphragm chamber associated with the working fluid and the manifold structure associated therewith. Such ball valve assemblies are commonly configured to prevent flows in the opposite operational flow direction or between discrete inlet and outlet passages during operation of the discrete the diaphragm pump assemblies.

Each ball valve assembly 250 includes a seat 252 that is commonly defined by a portion of the housing 254 or a manifold associated with the discrete working fluid diaphragm pump assembly. Unlike known diaphragm pump assemblies, ball valve assembly 250 includes a seal 256 that is supported by a groove 258 formed in seat 252. Seal 256 is configured to engage an exterior surface 261 of a ball 260 associated with each ball valve assembly 250 when the ball is oriented in a "closed" orientation relative to a respective working fluid flow passage 262 defined by housing 254 or a manifold associated therewith. Ball 260 includes an optional weight 264 that is oriented to gravitationally bias ball 260 into sealed engagement with seal 256.

Whereas rubber ball valves have proved unsatisfactory when systems 50, 200 are used for communicating paint materials to an application device, particularly at the low flow pressure values customary thereto, ball valve assemblies wherein the ball is formed of materials like Teflon and stainless steel are commonly selected but frequently do not seat properly at low pressure differentials between the opposing intake and discharge passages associated with the working fluid diaphragm pump assemblies and tend to result is cross contamination of the fluid flow signals from respective intake and discharge sides of the pump assembly. Such occurrences reduce the ability to accurately control the flow parameters at low flow pressures and volumes as disclosed above. Providing seal 256 and the additional weighting of ball 260 via weight 264 allows the working fluid diaphragm pump assemblies to be constructed in a manner that allows for the placement of a solvent resistant seal 256 in the form of an O-ring to improve the sealing performance associated with operation of ball valve assembly 250 at low working fluid diaphragm chamber conditions prior to development of a desired pressure differential relative to the opposing fluid sides of the ball valve assembly 250 and thereby more accurate control associated with the working fluid flow and working fluid flow pressure associated with operation of systems 50, 200.

Of course, specific details of the preferred embodiment as described herein are not to be interpreted as limiting the scope of the invention, but are provided merely as a basis for the claims and for teaching one skilled in the art to variously practice and construct the present invention in any appropriate manner. Changes may be made in the details of the construction of various components of the discrete pumping diaphragm pump assembly, without departing from the spirit of the invention as defined in the following claims.

What is claimed is:

1. A diaphragm pump system comprising:

a first pump assembly and a second pump assembly, each pump assembly comprising a housing, a working fluid pumping diaphragm disposed in the housing, and a shaft supported by the housing and attached to the working fluid pumping diaphragm such that the working fluid pumping diaphragm of each of the first pump assembly and the second pump assembly are independently operable relative to one another;

an unpressurized inlet manifold fluidly connected to an inlet side of each of the first pump assembly and the second pump assembly;

a discharge manifold fluidly connected to a discharge side of each of the first pump assembly and the second pump assembly;

a first diaphragm retracting assembly connected to the first pump assembly and configured to manipulate operation of the shaft of the first pump assembly and a second diaphragm retracting assembly connected to the second pump assembly and configured to manipulate operation of the shaft of the second pump assembly when an air flow is communicated to a respective one of the first diaphragm retracting assembly and the second diaphragm retracting assembly; and a control arrangement connected to the first diaphragm retracting assembly and the second diaphragm retracting assembly and configured to oscillate operation of the working fluid pumping diaphragm of the first pump assembly and the second pump assembly and concurrently apply a pressure signal to each of the first diaphragm assembly and the second diaphragm assembly near a full compression stroke associated with a discharge stroke of each of the respective work fluid pumping diaphragms of the first pump assembly and the second pump assembly to create a generally uniform discharge pressure associated with an outlet of the discharge manifold, the control arrangement including at least one electrical switch connected to the first diaphragm retracting assembly and at least one electrical switch connected to the second diaphragm retracting assembly, each electrical switch being configured to communicate an electrical signal to the control arrangement that is indicative of a relative position of a respective one of the working fluid pumping diaphragm of the first pump assembly and the second pump assembly relative to the respective housing.

2. The diaphragm pump system of claim 1 wherein each of the at least one electrical switch connected to each of the first diaphragm retracting assembly and the second diaphragm retracting assembly is further defined as a first limit switch and a second limit switch that are each configured to communicate an electrical signal to an electronic control system of the control arrangement.

3. The diaphragm pump system of claim 1 further comprising a first air manifold connected to each of the first pump assembly and the first diaphragm retracting assembly and a second air manifold connected to each of the second pump assembly and the second diaphragm retracting assembly.

4. The diaphragm pump system of claim 1 wherein operation of the first pump assembly is controlled by operation of the first diaphragm retracting assembly and operation of the second pump assembly is controlled by operation of the second diaphragm retracting assembly.

5. The diaphragm pump system of claim 4 wherein the first diaphragm retracting assembly controls both an intake pressure and a discharge pressure associated with operation of the first pump assembly and the second diaphragm retracting assembly controls both an intake pressure and a discharge pressure associated with operation of the second pump assembly.

6. A method of forming a diaphragm pump assembly, the method comprising:

connecting a first working fluid pumping diaphragm pump assembly to a first diaphragm retracting assembly;

connecting a second working fluid pumping diaphragm pump assembly to a second diaphragm retracting assembly that is independently operable relative to the first working fluid pumping diaphragm pump assembly;

connecting the first working fluid pumping diaphragm pump assembly and the second working fluid pumping diaphragm pump assembly to a respective unpressurized working fluid intake and a respective working fluid discharge;

detecting a position of the first diaphragm retracting assembly and determining a position of a diaphragm of the first working fluid pumping diaphragm pumping assembly and detecting a position of the second diaphragm retracting assembly and determining a position of a diaphragm of the second working fluid pumping diaphragm pumping assembly; and controlling operation of the first diaphragm retracting assembly and the second diaphragm retracting assembly to effectuate operation of the first working fluid pumping diaphragm pump assembly and the second working fluid pumping diaphragm pump assembly in a sequential manner and with a timewise shift to provide an offset between initiation of discharge strokes of the first working fluid pumping diaphragm pump assembly and the second working fluid pumping diaphragm pump assembly so that a discharge stroke of a respective diaphragm of one of the first working fluid pumping diaphragm pump assembly and the second working fluid pumping diaphragm pump assembly begins before the respective diaphragm of the other of the first working fluid pumping diaphragm pump assembly and the second working fluid pumping diaphragm pump assembly approaches an end of a respective discharge stroke a flow value and a pressure value associated with a combined output of the working fluid discharges based on the determination of the positions of the diaphragms of the first and second working fluid pumping diaphragm pumping assemblies.

7. The method of claim 6 further comprising providing at least one limit switch associated with the detecting of the position of each of the first diaphragm retracting assembly and the second diaphragm retracting assembly and connecting the at least one limit switch to a controller associated with controlling operation of the first diaphragm retracting assembly and the second diaphragm retracting assembly.

8. The method of claim 7 further comprising providing each of the first diaphragm retracting assembly and the second diaphragm retracting assembly with a respective discharge stroke limit switch and a respective intake stroke switch limit switch.

9. The method of claim 6 further comprising connecting an air manifold to each of the first diaphragm retracting assembly and the second diaphragm retracting assembly to effectuate sequential operation of each of the respective first diaphragm retracting assembly and the second diaphragm retracting assembly.

10. The method of claim 6 further comprising connecting each of the first diaphragm retracting assembly and the second diaphragm retracting assembly to a controller that is configured to communicate a pneumatic instruction signal to the respective first diaphragm retracting assembly and second diaphragm retracting assembly.

11. The method of claim 6 further comprising forming at least one of the first diaphragm retracting assembly and the second diaphragm retracting assembly with a diaphragm disposed in a housing and fluidly isolated from a working fluid that is moved via operation of the respective one of the first working fluid pumping diaphragm pump and the second working fluid pumping diaphragm pump.

12. The method of claim 6 further comprising providing a seal associated with at least one of a working fluid inlet and a working fluid outlet defined by at least one of the first working fluid pumping diaphragm pump and the second working fluid pumping diaphragm pump.

13. The method of claim 12 further comprising a ball valve configured to seat upon the seal.

14. The method of claim 13 further comprising providing a weight attached to the ball valve and oriented to bias the ball into engagement with the seal.

15. A diaphragm pump system comprising:

a first working fluid diaphragm pump assembly and a second working fluid diaphragm pump assembly, each of the first working fluid diaphragm pump assembly and the second diaphragm pump assembly including a respective diaphragm that is disposed in a respective working fluid diaphragm pump chamber;

a first drive arrangement that is fluidly isolated from a working fluid flow and is connected to the diaphragm of the first working fluid diaphragm pump assembly, the first drive arrangement being pneumatically operable to effectuate cyclic operation of the diaphragm of the first working fluid diaphragm pump assembly relative to the working fluid diaphragm pump chamber of the first working fluid diaphragm pump assembly;

a second drive arrangement that is fluidly isolated from the working fluid flow and is connected to the diaphragm of the second working fluid diaphragm pump assembly, the second drive arrangement being pneumatically operable to effectuate cyclic operation of the diaphragm of the second working fluid diaphragm pump assembly relative to the working fluid diaphragm pump chamber of the second working fluid diaphragm pump assembly; and a control arrangement connected to each of the first drive arrangement and the second drive arrangement and having at least one sensor associated with each of a respective one of the first drive arrangement and the second drive arrangement that are configured to detect a relative position of the respective diaphragm that is disposed in the respective working fluid diaphragm pump chamber of each of the first working fluid diaphragm pump assembly and the second working fluid diaphragm pump assembly, the control arrangement being configured to control operation of the first working fluid diaphragm pump assembly and the second working fluid diaphragm pump assembly and concurrently apply a pressure signal to each of the first drive arrangement and the second drive arrangement near a full compression stroke associated with a discharge stroke of each of the first working fluid diaphragm pump assembly and the second working fluid diaphragm pump assembly to provide an overlap during respective discharge strokes of the first working fluid diaphragm pump assembly and the second diaphragm pump assembly when a respective one of the first working fluid diaphragm pump assembly and the second diaphragm pump assembly approach an end of a respective discharge stroke to create a steady state condition of a pressure and a flow of the combined working fluid discharged from the first working fluid diaphragm pump assembly and the second working fluid diaphragm pump assembly and based at least in part on outputs from each of the at least one sensor associated with each of the respective one of the first drive arrangement and the second drive arrangement.

16. The diaphragm pump system of claim 15 wherein the at least one sensor associated with each of the respective one of the first drive arrangement and the second drive arrangement of the control arrangement is further defined as at least one limit switch associated with each of the first drive arrangement and the second drive arrangement and configured to communicate an electrical signal to the control arrangement.

17. The diaphragm pump system of claim 15 wherein each of the first drive arrangement and the second drive arrangement includes at least one of a diaphragm assembly and a piston assembly.

18. The diaphragm pump system of claim 15 further comprising at least one ball valve assembly associated with each of the first working fluid diaphragm pump assembly and the second working fluid diaphragm pump assembly, the at least one ball valve assembly including a ball, a seat defined by a housing of a respective one of the first working fluid diaphragm pump assembly and the second working fluid diaphragm pump assembly, and a seal supported by the seat and oriented to engage the ball.

19. The diaphragm pump system of claim 18 further comprising a weight attached to the ball and oriented to gravitationally bias the ball into engagement with the seal.

20. The diaphragm pump system of claim 15 wherein the control arrangement is configured to at least one of independently control a retraction stroke speed associated with each of the first and second drive arrangements relative to one another and independently control a discharge stroke speed associated with each of the first and second working fluid diaphragm pump assemblies relative to one another as a function of output of the at least one sensor associated with each of the respective one of the first drive arrangement and the second drive arrangement.

* * * * *